United States Patent [19]

Pavlick

[11] Patent Number: 5,001,990

[45] Date of Patent: Mar. 26, 1991

[54] WELL CAR APPARATUS

[75] Inventor: Michael J. Pavlick, Blue Bell, Pa.

[73] Assignee: Transit America, Inc., Philadelphia, Pa.

[21] Appl. No.: 409,312

[22] Filed: Sep. 19, 1989

[51] Int. Cl.[5] ..... B61D 17/10

[52] U.S. Cl. ..... 105/375; 105/371; 410/54; 410/56

[58] Field of Search ..... 105/355, 371, 375; 410/3, 4, 46, 54, 56

[56] References Cited

U.S. PATENT DOCUMENTS

| | | | |
|---|---|---|---|
| 1,271,413 | 7/1918 | Allen | 105/375 |
| 1,405,655 | 2/1922 | Zaun | 105/375 |
| 3,116,950 | 1/1964 | Chieger et al. | 105/371 |
| 3,250,232 | 5/1966 | Aquino et al. | 410/54 |
| 3,266,836 | 8/1966 | Taylor et al. | 410/54 |
| 3,912,139 | 10/1975 | Bowman | 410/3 |
| 4,132,323 | 1/1979 | Simmons | 410/3 |
| 4,562,633 | 1/1986 | Adams et al. | 105/355 |
| 4,825,778 | 5/1989 | Riley | 410/54 |

*Primary Examiner*—Robert J. Oberleitner
*Assistant Examiner*—S. Joseph Morano
*Attorney, Agent, or Firm*—Walter B. Udell

[57] ABSTRACT

Apparatus for adapting well cars for trailer carrying use without degrading its double stacked container capability, including a trailer hitch head and mounting pedestal attached to the end deck of the well car for securing the trailer kingpin onto the car mounted hitch head, and a plurality of lightweight aluminum floor beams or panels which support the trailer bogies. The beams can be dropped into place on the car floor with locating pins providing the fore and aft positioning, and are sufficiently light that two men can lift and position them. In two forms the beams bridge between the lower side sills of the car and transfer the vertical load by bearing on the inward turned flange portion of the side sill, and in another form are partly supported by the car lower end plate. The floor beams structures add only approximately 500 to 600 pounds in weight, rather than the 5,000 pounds of a permanent type floor, and do not raise the trailer height above the normal double stacked container height. The floor beams height, on the order of one foot, permits the trailer to be loaded onto the well car with the trailer landing gear in fully downwardly extended position instead of having to retract the landing gear, which permits the trailer to be loaded and unloaded at siding in approximately half the time it takes to load and unload if the landing gear had to be raised and lowered. The height of the floor beams stops the vertical descent of the trailer at a point were there is adequate clearance for the crane loading arms to release the trailer after depositing it into the well car. Means for locking the beams assembly together is provided.

19 Claims, 6 Drawing Sheets

FIG. 7
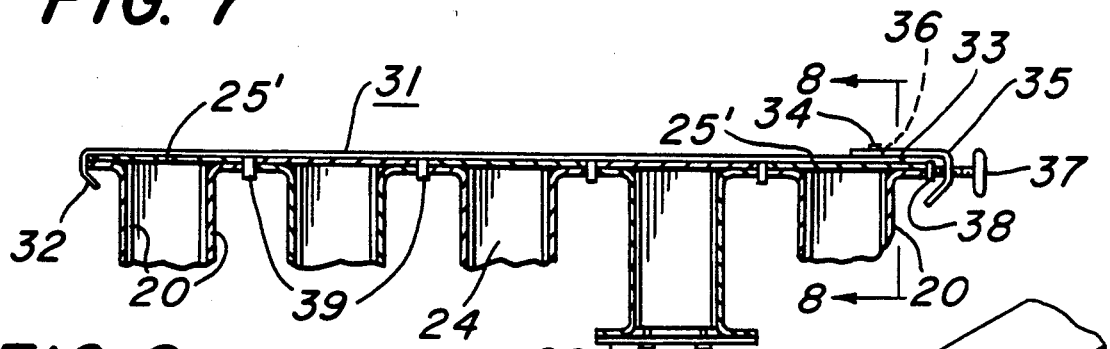
FIG. 8
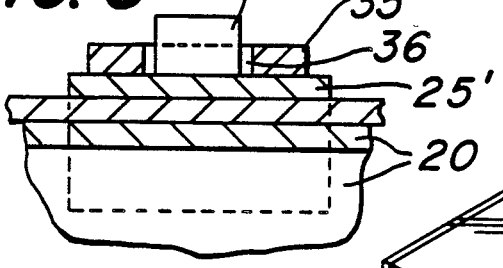
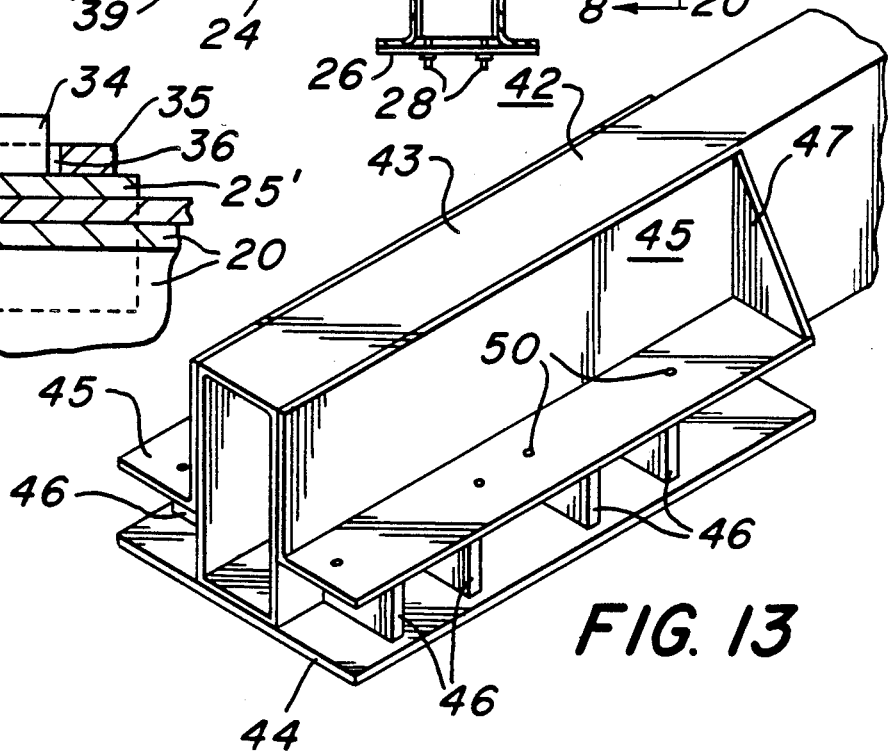
FIG. 13
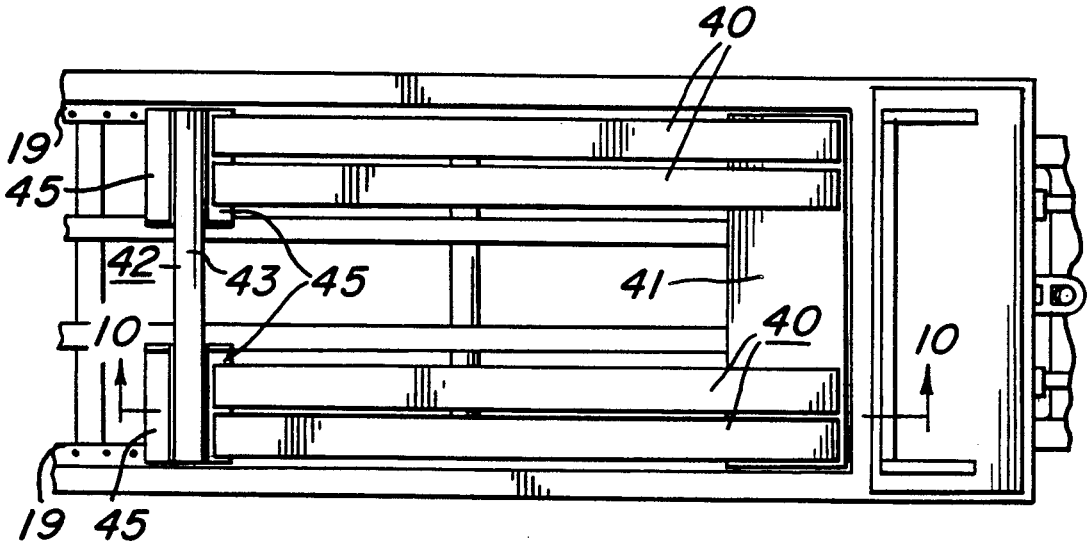
FIG. 9

WELL CAR APPARATUS

This invention relates generally to railroad well cars of the type which are used for carrying double-stacked containers. When these cars were developed for railroad use, and for sometime thereafter, they were built with wells for accommodating 40 foot long containers. There are more than two thousand such units presently in service on American railroads. At the present time the tendency in the container industry is to increase container lengths to 45 feet, 48 feet and even to 53 feet. The 40 foot well cars will become increasingly obsolete as more of these oversized containers come into use, and it may become difficult to find 40 foot loads for such cars in some markets, forcing the cars to operate partially empty. The present invention makes it possible to load these empty well cars with trailers. The trailers can be at least 45 feet in length, and in some cases even 48 feet because a part of the trailer overhangs the well car deck beyond the well location. The present invention provides apparatus for adapting the 40 foot well cars for trailer carrying use without degrading its double-stacked container capability.

The adaptation of the 40 foot well cars to trailer use involves two components. One component is a trailer hitch head and mounting pedestal that can be attached to the end deck of the well car for securing the trailer kingpin onto the car mounted hitch head. While the hitch head could be made demountable, since it weighs only on the order of 500 pounds, it can be fixedly mounted on the car deck as a permanent structural part of the car without measurably reducing the load carrying capabilities of the well car. The second component of the adaptation is a plurality of lightweight aluminum floor beams or panels which support the trailer bogies. These panels can be dropped into place on the floor with locating pins providing the fore and aft positioning. The panels are sufficiently light that two men can lift and position them, weighing on the order of approximately 120 pounds each. The panels bridge between the lower side sills of the car and transfer the vertical load by bearing on the inward turned flange portion of the side sill.

The trailers cannot be directly placed into the standard well cars without an auxiliary floor structure because the normal floor structure of the well cars when used for carrying containers is substantially completely open and provides no points of support for the trailer wheels. A permanently installed flooring section would be exceedingly heavy, on the order of perhaps 5,000 pounds, if it were to be vertically thin enought to avoid unduly raising the height of double stacked containers. Double-stacked containers at the present time can rise 17 feet to 19 feet above the well car support sills, and raising the height substantially further could create severe problems in permitting double-stacked passage through some railroad tunnels, but more importantly it would severely reduce the load carrying capability of the well cars.

The apparatus according to the invention, by consisting of rigid floor beams only present at the support point for the trailer bogie, and not throughout the length of the car, can be made sufficiently vertically high to provide excellent beam strength while not raising the trailer to an excessive height. Floor beams on the order of one foot in height will raise the top of a carried trailer only about 14½ feet, still substantially below the double-stacked container height. The floor beams structures add only approximately 500 to 600 pounds in weight, rather than the 5,000 pounds of a permanent type floor.

Moreover, the one foot floor beam height permits the trailer to be loaded onto the well car with the trailer landing gear in fully downwardly extended position instead of having to retract the landing gear. This permits the trailer not only to be loaded, but also to be unloaded at a siding in approximately half of the time it would take to load and unload if the landing gear had to be raised and lowered. Finally, the height of the well car side walls is such that if the trailer were attempted to be loaded directly into the well with the bogie wheels substantially at the container floor level, the arms of the loading crane would be jammed on the car side-wall top rails and could not release the trailer. The height of the floor beams stops the vertical descent of the trailer at apoint were there is adequate clearance for the crane loading arms to release the trailer after depositing it into the well car.

A primary object of the invention is to provide a novel railroad well car floor beam structure which is quickly and easily installable and removable to convert the well car to carry trailers with the floor beams installed, and to carry double-stacked containers when the floor beams are removed.

Another object of the invention is to provide a novel railroad well car floor beam structure as aforesaid which is light in weight, relatively inexpensive, while having a very high strength to weight ratio.

A further object of the invention is to provide a novel railroad well car floor beam structure as aforesaid which includes means for positionally stabilizing the installed floor beams to prevent walking or creeping movement relative to the railroad car.

The foregoing and other objects of the invention will become clear from a reading of the following specification in conjunction with an examination of the following drawings, wherein:

FIG. 7 and 8 show details of a clamping device for fixedly intersecuring the floor beam structure after it has been installed in the well car; and FIG. 9 through 13 illustrate an alternative embodiment of the novel floor structure according to the invention in which the floor beams run fore and aft of the well car length instead of transversely thereto.

In the several figures, like elements are denoted by like reference characters.

Figure 1:
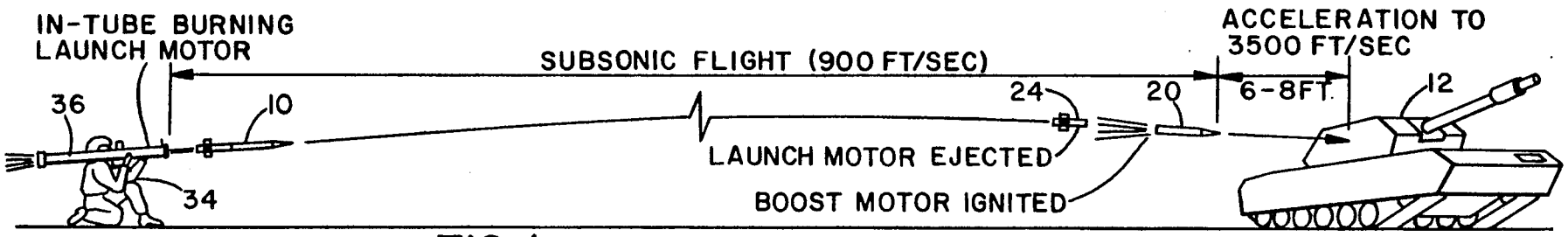
FIG. 1 is a side elevational view showing generally the installation of a trailer in a well car utilizing the invention.
Figure 3:
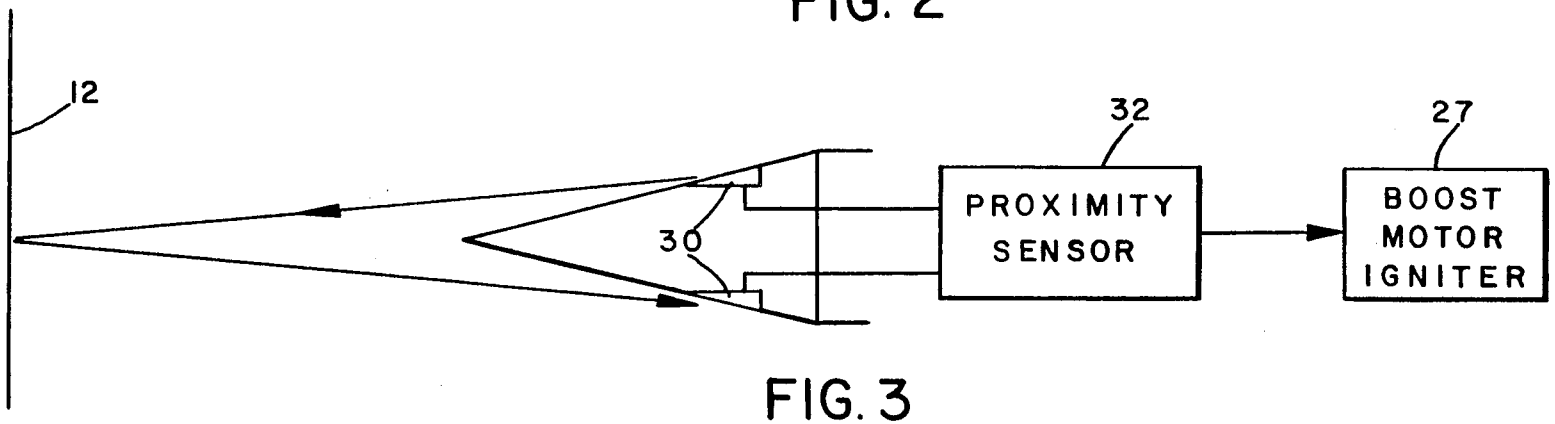
FIG. 3 is a plan view similar to that of FIG. 2 but showing the entire railraod car and the flooring structure according the invention installed over the open-work bottom of the railroad well car.
Figure 1:
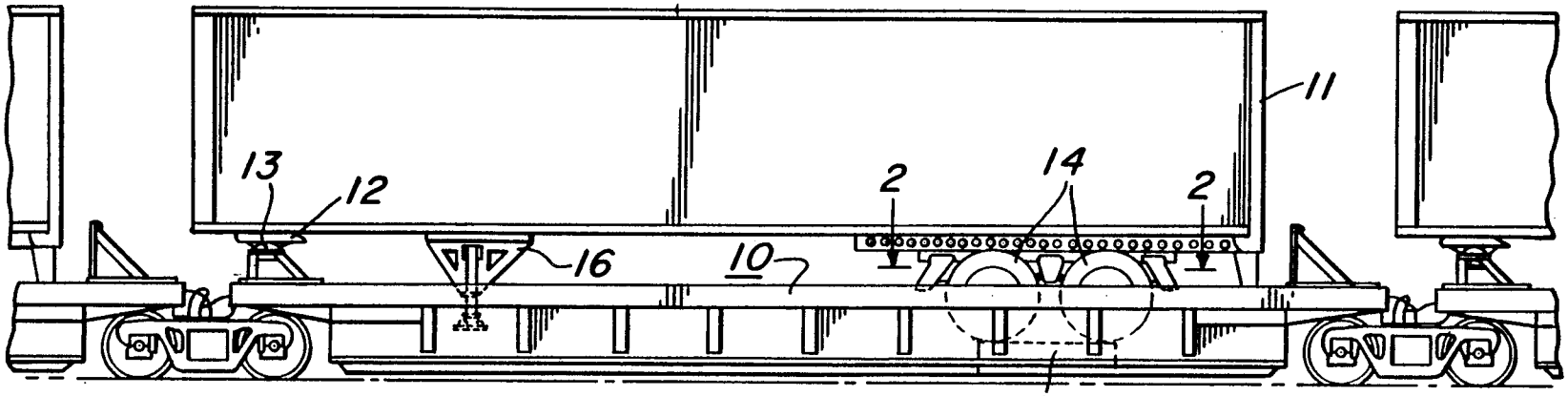
Figure 3:
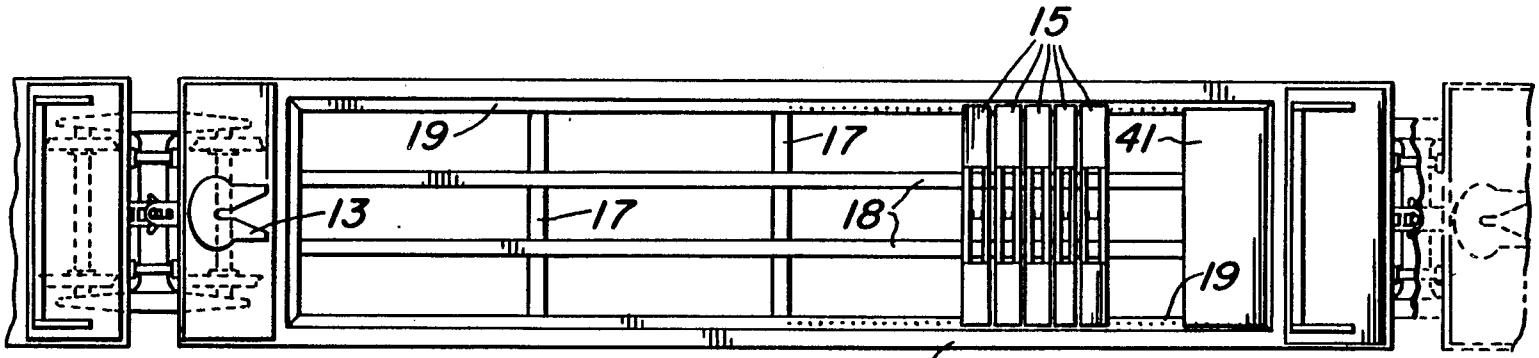

Turning now to an examination of the drawings, and considering first FIG. 1, there is seen a railroad well car designated generally as 10 into which is seated a trailer 11 having its kingpin 12 securely engaged with hitch head 13 mounted on the end deck of the railroad car 10. The position of the trailer bogie is such that the trailer wheels 14 are seated on an array of floor beams 15 according to the invention. The trailer landing gear 16 is shown in its fully extended position clear of the underlying well car floor structure. The open gridwork bottom structure of the well car 10 is best seen in the showing of FIG. 3 as the widely spaced transversely extending cross members 17 and longitudinally extending members 18, these members being relatively widely spaced and welded to one another and to the rail car bottom sills 19. It is clear from the showing of FIG. 3 that without the floor beams according to the invention, the trailer wheels would have no support from the normal well car floor structure.

Figure 2:
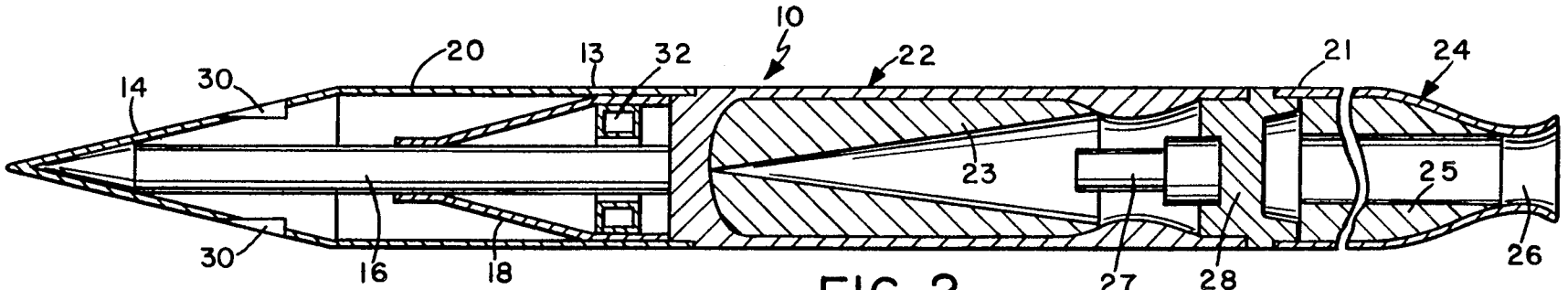
FIG. 2 is a partial plan view on an enlarged scale of the floor beam structure according to the invention as would be seen when viewed along the line 2—2 on FIG. 1.
Figure 4:
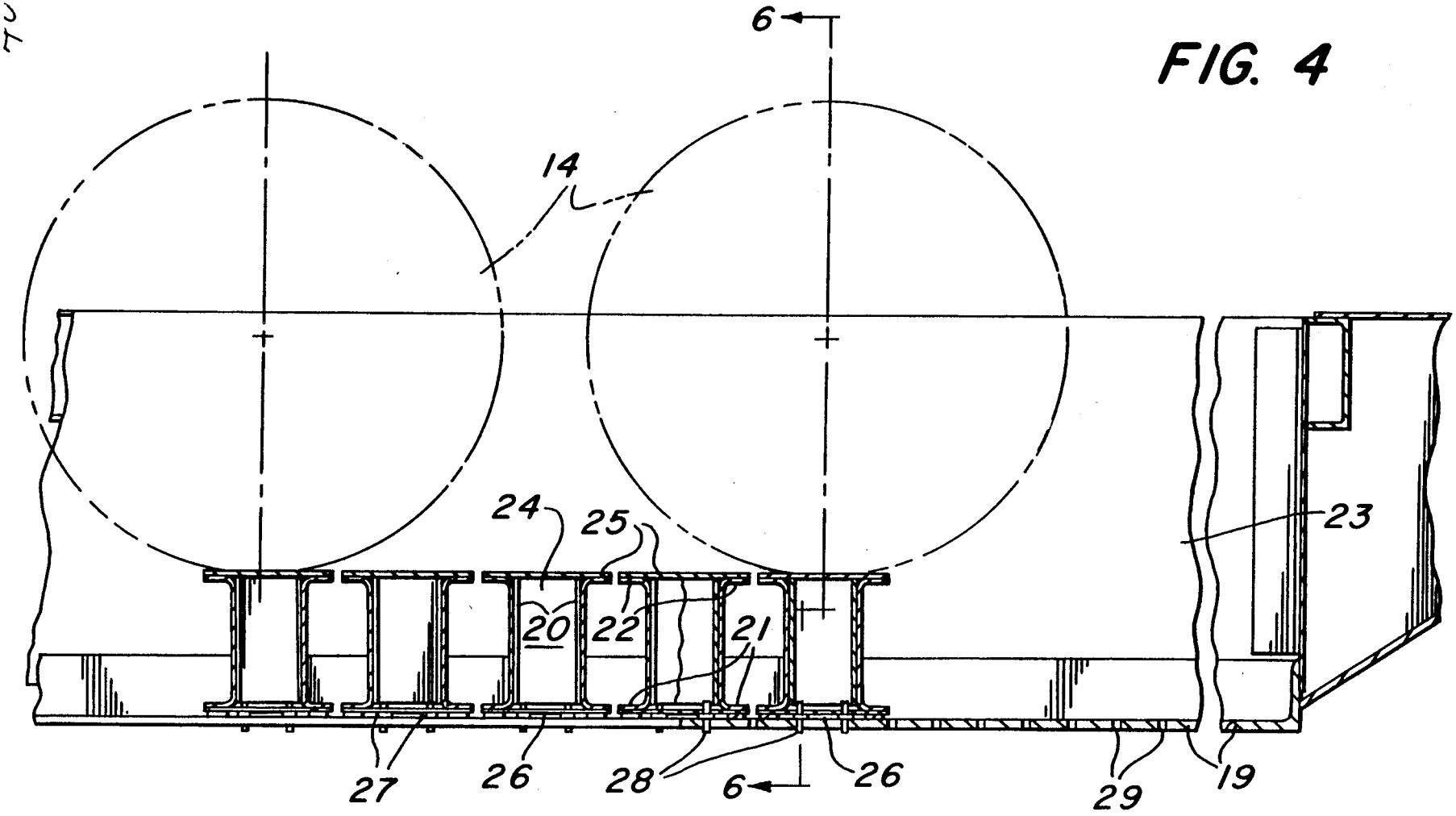
FIG. 4 is a vertical section showing the floor beam structure according to the invention as would be seen when viewed along the jump section lines 4—4 shown in FIG. 2.
Figure 6:
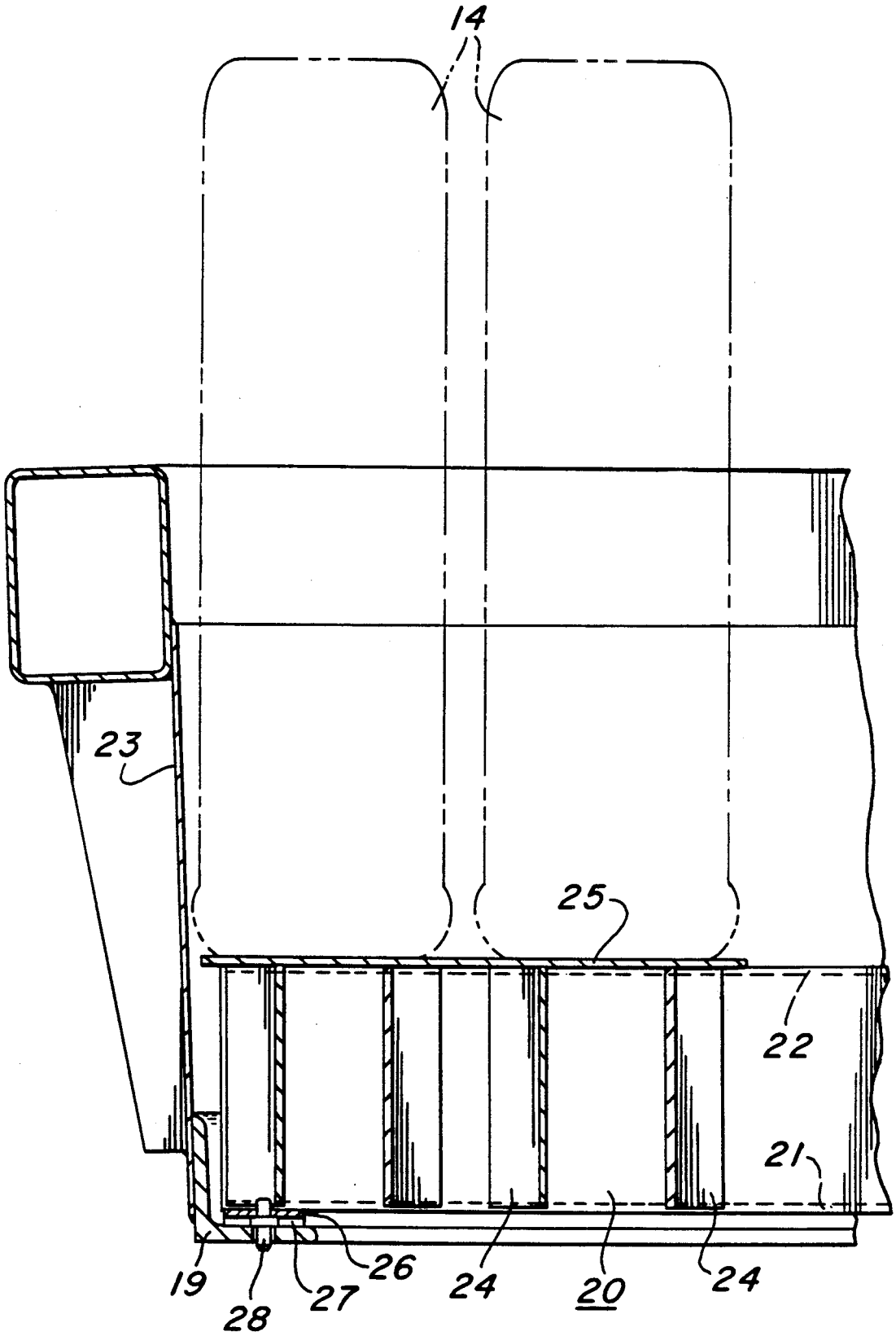
FIG. 6 is a vertical cross sectional view through one of the floor beams according to the invention as would be seen when viewed along the lines 6—6 on FIG. 4.

As best seen in FIGS. 2, 4 and 6, each of the floor beams 15 consist of a pair of channel members 20 oriented with the channel base walls vertical and having the flanges 21 disposed horizontally at the lower ends of the beams and the flanges 22 disposed horizontally at the upper end of the beams. As best seen in FIG. 6, these channels 20 run substantially from side to side of the well car between the well car side walls 23. The two channel members 20 of the beam 15 are spaced apart and rigidly secured together by vertical channel secitons 24, and the upper flanges 22 of the channel members 20 having rigidly affixed thereto, as by welding or bolting, the top plates 25 which overlie the four vertical channel sections 24 lying immediately inward from each end of each beam 15. The lower flanges 21 of the channel members 20 are rigidly secured together at their ends by bottom plates 26.

Figures 2, 5:
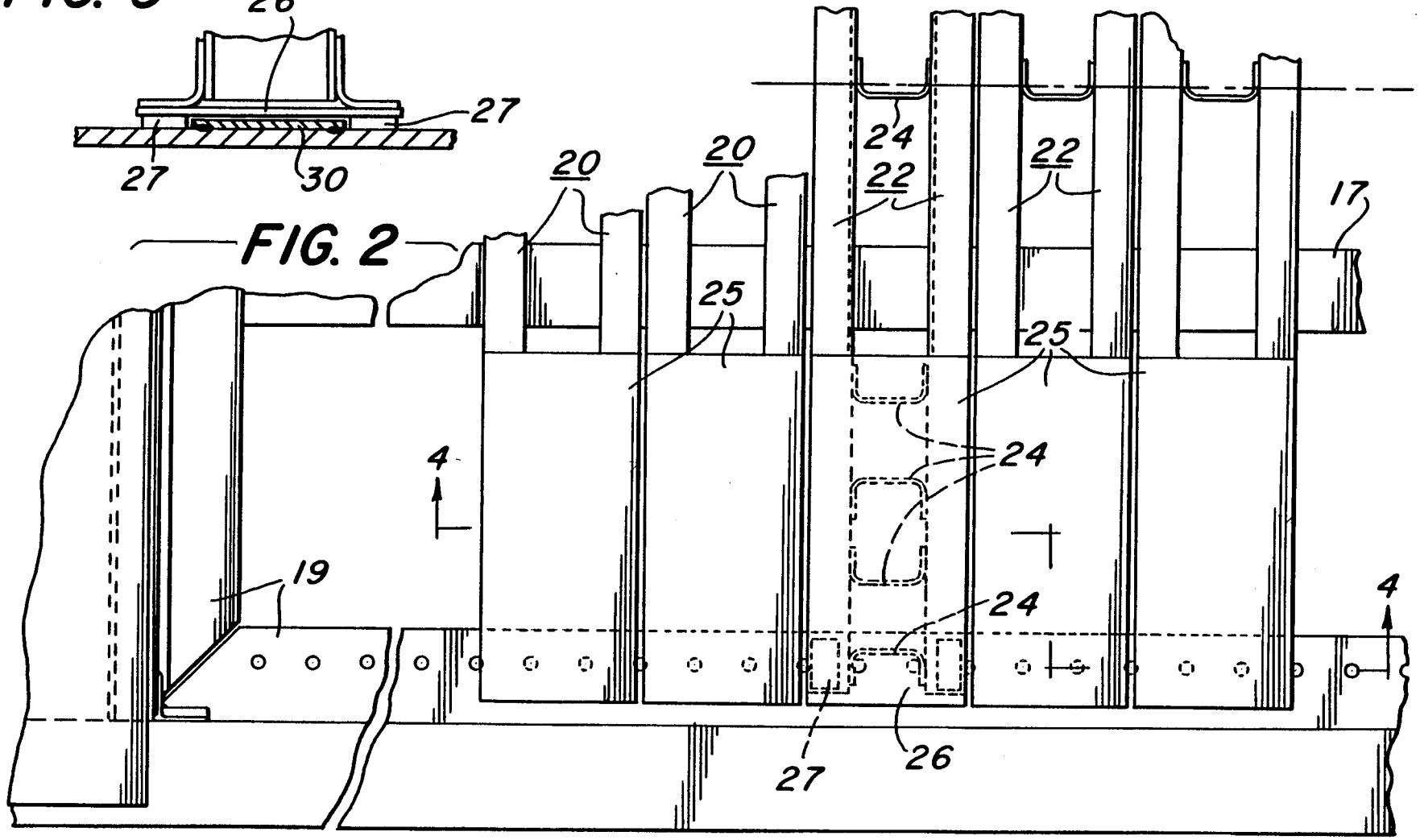
FIG. 5 is a detail view showing an alternative structure for preventing the floor beams for walking with regard to the railroad car.

Fixedly secured to the bottom surfaces of the bottom plates 26 at the outer edges thereof are anti-rocking bottom pads 27 which seat upon the horizontal flange of the bottom sills 19. Press fitted into the bottom plates 26 of each beam end are a pair of pins 28 freely projectable downward through sidewalls bottom sills holes 29, which latter are required to be drilled or punched through the existing well car bottom sills. As best seen in FIG. 5, an alternative to the pins 28 and holes 29 utilizes the provision of a locating block 30, welded, riveted or otherwise fixedly secured to the bottom sills 19 at intervals such that the bottom pads are positionable on opposite ends of the locating block 30.

Typically, although not necessarily, a floor beam 15 could be constructed using channels 20 which are 11½ inches high having 3 inch flanges and being ¼ inch thick, while being on the order of 8 feet long. The top plate 25 and bottom plate 26 could typically be of ¼ thick stock 12 inches wide, the top plate being substantially 30 inches long and the bottom plate being approximately 4 inches long. The vertical channel sections 24 could be of 6 inch channel width having 3 inch flanges and also being ¼ inch thick, while the pins 28 could be 1 inch diameter coated steel.

While the floor beams just described will normally stay in position under the weight of a trailer being carried, in order to insure stabilization of the multiple beam arrangement, a locking tie structure may be utilized to fixedly intersecure the beams of the floor structure together as a unit, thereby providing stabilization for each individual beam by the coupled mass of the other beams. FIGS. 7 and 8 show one possible locking structure, and they show a vertical section through the floor beams as seen in FIG. 4 previously described, but in which the section would be taken transversely to the beams at about the beams center points. As shown in FIG. 7, there are fixedly secured to the upper flanges of the channel members 20 a top plate 25' which may typically be on the order of 4 inches to 6 inches in width.

Disposed flatwise upon the center top plates 25' is a strapping member 31 having an inwardly hooked end 32 turning downward under the center top plate 25' and the upper flange channel member 20, and extending transversely across all of the beams to a terminating end 33 from which upwardly projects a hook 34. Captured on the hook 34 in a J-shaped clamp end 35 formed with a central slotted aperture 36 through which the hook 34 is projected. Threaded through the end of the clamp end 35 is a handled jacking bolt 37 having an end pad 38 which may be brought into bearing engagement with the edge of the center top plate 25' and upper flange of the channel member 20 by screwing in the jacking bolt 37.

Rigidly secured to and extending downward from the undersurface of the strapping member 31 are a plurality of spacers 39 properly located and of the proper width to align with the spaces between the upper longitudinally extending edges of the adjacent beams. With these spacers in position as indicated, when the jacking bolt 37 is rotated so that the end pad 38 bears against the edge of the center top plate, all of the beams are fixedly locked together and are effectively restrained from vertical bouncing and individual rotation. While a single such strapping member 31 may be used successfully in a central location, if desired, a pair of such devices could be used spaced off of the center line and somewhat outward toward the ends of the beams. Moreover, if desired, the center top plates 25' could be omitted, and the clamping could be effected directly to the beams upper flanges.

FIGS. 9 through 13 show an alternative embodiment of the floor beam structure in which the beams for supporting the trailer wheels do not extend transversely to the width of the car from side to side, but instead extend longitudinally as shown most clearly in FIG. 9 in which the floor beams 40 have their right hand ends seated on the well car lower end plate 41, and have their opposite end seated on a beam 42 which extends transversely of the well car, and which is itself carried by the well car side walls bottom sills 19.

As best seen in FIGS. 9 and 13, the transverse beam 42 includes a rectangular tube 43 having fixedly secured to the bottom thereof a bottom plate 44 extending for a distance inward from each end of the tube 43. Fixedly secured to the upper side faces of the rectangular tube 43 are a pair of angles 45, with the horizontal flanges of the angles being rigidly affixed to the upper surface of the bottom plate by the intervening vertical support plates 46. Gusset plates 47, as shown in FIG. 13, may be also secured to the inner ends of the angles 45 if desired. Pins 48 extending downward from the undersides of the ends of the transverse beams 42 may be projected through holes in the sidewalls bottom sills 19 in the manner previously described in connection with the pins 28 of the first embodiment described.

Figure 10:
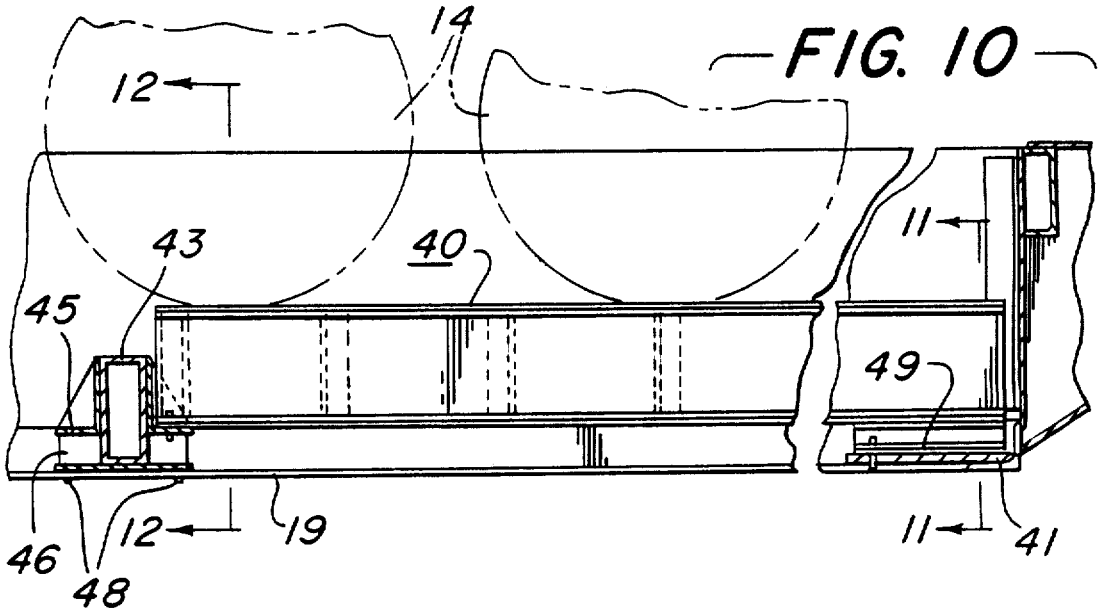
Figure 11:
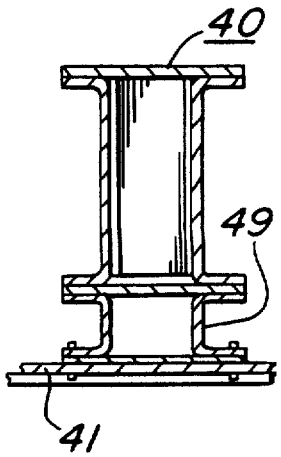
Figure 12:
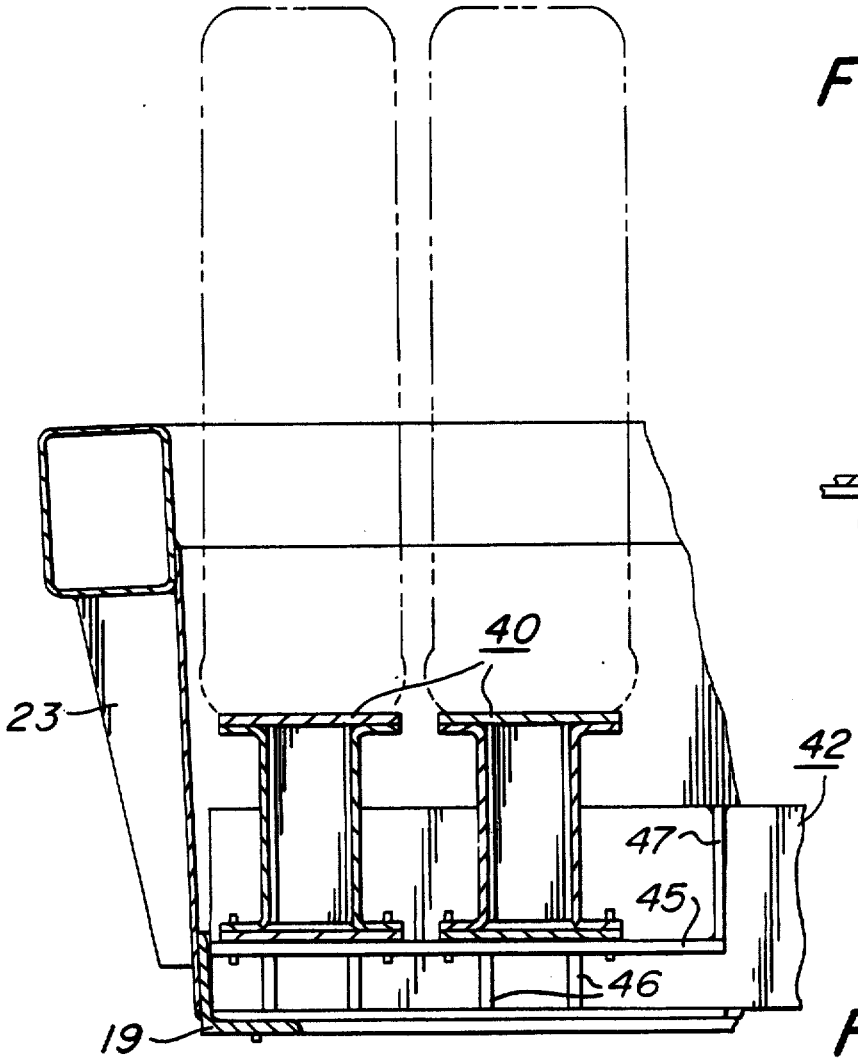

The structure of the beams 40 is best seen in the showings of FIGS. 10, 11 and 12, in which it is observed that the structure of the beams 40 is the same as that of the previously described beams 15, with the exception that they may be slightly shorter in vertical height due to the elevated arrangement of the end which sits upon the angle 45 of the transverse beam 42, which arrangement also necessitates the use of an end spacer pad 49 rigidly secured to the underside of the beams 40 at the opposite end which seats upon the well car lower end plate 41. The beams 40 are keyed to the transverse beam 42 and the well car lower end plate 41 in any convenient manner, as for example by the use of counterparts to pins 28, which could for example be downwardly projected into holes such as that shown at 50 through the angles 45 of the transverse beam 42. Any other suitable form of keying interfit or interlock could as well be used, and the beams if desired could be locked together by strapping members similar to those already described in connection with the showings of FIG. 7 and 8.

Another embodiment of the invention consists of a pair of parallel spaced apart transverse beams 42 which support beams identical to the beams 40, except that they are not provided with end spacer pads 49. This arrangement can be located in the same way as the floor structure shown in FIGS. 1 to 6.

Having now described the invention in connections with particularly illustrated embodiments thereof, modifications and variations of the invention may now naturally occur to those persons normally skilled in the art without departing from the essential scope or spirit of the invention, and accordingly it is intended to claim the same broadly as well as specifically as indicated by the appended claims.

What is claimed is:

1. A quickly installable and removable lightweight floor structure for railroad well cars of the type having sidewalls and bottom sills, for converting the well car from use with containers to one for carrying trailers, comprising in combination, a plurality of substantially equal height lightweight beams, each said beam being light enough to be readily handlable by two men and being disposable side by side to form a platform for the wheels of a trailer, the height of said beams being such as to raise the underside of a trailer to an elevation above the well car sidewalls a sufficient distance to provide withdrawal clearance for the loading arms of a trailer loading crane when the wheels of the trailer being loaded have been seated in the well car on the beams, and coupling means for coupling said removable floor structure to the bottom sills of the well car sidewalls effective to restrain movement of said removable floor structure relative to said well car, said coupling means comprising interfitting elements some of which are carried by the beams bottoms and some of which are carried by the well car.

2. A floor structure as set forth in claim 1 wherein each of said beams is of sufficient length to fit between and span the distance between the well car sidewalls.

3. A floor structure as set forth in claim 1 wherein each of said beams is of sufficient length to fit between and span the distance between the well car sidewalls, and wherein said coupling means couples said removable floor structure to the well car sidewalls and is effective to prevent fore and aft movement of said removable floor structure relative to the well car.

4. A floor structure as set forth in claim 1 wherein said beams height is sufficient to elevate a fully downwardly extended trailer landing gear above the normal floor plane of the well car when the trailer is seated in the well.

5. A floor structure as set forth in claim 1 wherein said coupling means couples said removable floor structure to the bottom sills of the well car sidewalls and comprises pins projecting downward from the beams ends which are projectable through holes in the bottom sills.

6. A floor structure as set forth in claim 1 wherein each said beam comprises, (a) a pair of parallel longitudinally extending horizontally spaced members slightly shorter in length than the width of the well car in which it is to be installed, said member having upper and lower edges, (b) a plurality of spacers positioned between and each rigidly secured to both of said members between the said upper and lower edges of the latter, (c) a pair of top plates rigidly secured to the upper edges of said pair of members and each extending inward respectively from one of the opposite ends of said beam for a sufficient distance to support thereon the wheels of a trailer, and (d) means for coupling said beam to the well car sidewalls effective to prevent said beam from fore and aft movement relative to said well car.

7. A floor structure as set forth in claim 6 further including a pair of bottom plates rigidly secured to the lower edges of said pair of members and each extending inward for a distance respectively from one of the opposite end of said beam.

8. A floor structure as set forth in claim 6 wherein said parallel longitudinally extending horizontally spaced members are channel members, and the said upper and lower edges thereof are the channel flanges.

9. A floor structure as set forth in claim 6 wherein said parallel longitudinally extending horizontally spaced members are channel members, and the said upper and lower edges thereof are the channel flanges, and wherein said spacers are channel sections oriented so that the lengthwise direction of said spacers channel sections is vertical with the spacer channel sections opposite flanges rigidly secured to different ones of said channel members.

10. A floor structure as set forth in claim 6 further including locking means for locking said plurality of beams together to resist vertical and rotational movement of each individual beam.

11. A floor structure as set forth in claim 1 wherein said coupling means comprises a transverse support beam extending between and supported by the well car sidewalls, and wherein said floor beams each have one end carried by said support beam and have their opposite ends carried by a lower end plate of the well car.

12. A floor structure as set forth in claim 11 further including locking means for locking said plurality of beams together to resist vertical and rotational movement of each individual beam.

13. A floor structure as set forth in claim 11 wherein each said beam comprises, (a) a pair of parallel longitudinally extending horizontally spaced members having upper and lower edges, (b) a plurality of spacers positioned between and each rigidly secured to both of said members between the said upper and lower edges of the latter, (c) a top plate rigidly secured to the upper edges of said pair of members and extending inward from one of the ends of said beam for a sufficient distance to support thereon the front and rear wheels of a trailer, and (d) means for coupling said beam to the well car effective to prevent said beam from fore and aft movement relative to said well car.

14. A floor structure as set forth in claim 13 further including a pair of bottom plates rigidly secured to the lower edges of said pair of members and each extending inward for a distance respectively from one of the opposite ends of said beam.

15. A floor structure as set forth in claim 13 wherein said parallel longitudinally extending horizontally spaced members are channel members, and the said upper and lower edges thereof are the channel flanges.

16. A floor structure as set forth in claim 13 wherein said parallel longitudinally extending horizontally spaced members are channel members, and the said upper and lower edges thereof are the channel flanges, and wherein said spacers are channel sections oriented so that the lengthwise direction of said spacers channel sections is vertical with the spacer channel sections opposite flanges rigidly secured to different ones of said channel members.

17. A floor structure as set forth in claim 13 further including locking means for locking said plurality of beams together to resist vertical and rotational movement of each individual beam.

18. A floor structure as set forth in claim 1 further including locking means for locking said plurality of beams together to resist vertical and rotational movement of each individual beam.

19. A floor structure as set forth in claim 1 wherein said coupling means comprises a pair of spaced apart parallel transverse support beams extending between and supported by the well car sidewalls, and wherein said floor beams each have their opposite ends respectively carried by said support beams.

* * * * *

UNITED STATES PATENT AND TRADEMARK OFFICE

CERTIFICATE OF CORRECTION

PATENT NO. : 5,001,990

DATED : March 26, 1991

INVENTOR(S) : Michael J. Pavlick

It is certified that error appears in the above-identified patent and that said Letters Patent is hereby corrected as shown below:

The drawing sheet consisting 1 of 6 should be deleted.

The sheet of drawings consisting of Figs. 10-12, should be added as shown on the attached sheet.

The drawing sheet should be deleted to appear as follows:

2 of 6 should be 1 of 6

3 of 6 should be 2 of 6

4 of 6 should be 3 of 6

5 of 6 should be 4 of 6

6 of 6 should be 5 of 6

Signed and Sealed this

Nineteenth Day of November, 1991

*Attest:*

HARRY F. MANBECK, JR.

*Attesting Officer*

*Commissioner of Patents and Trademarks*